US010913274B2

(12) United States Patent
Li et al.

(10) Patent No.: US 10,913,274 B2
(45) Date of Patent: Feb. 9, 2021

(54) NOZZLE MOUNT ARRANGEMENT AND INKJET PRINTER

(71) Applicant: SHENZHEN RUNTIANZHI DIGITAL EQUIPMENT CO., LTD., Shenzhen (CN)

(72) Inventors: Li Li, Shenzhen (CN); Longfei Zeng, Shenzhen (CN); Binbin Chen, Shenzhen (CN); Bizhen Liao, Shenzhen (CN); Hong Jiang, Shenzhen (CN)

(73) Assignee: SHENZHEN RUNTIANZHI DIGITAL EQUIPMENT CO., LTD., Shenzhen (CN)

( * ) Notice: Subject to any disclaimer, the term of this patent is extended or adjusted under 35 U.S.C. 154(b) by 0 days.

(21) Appl. No.: 16/652,278

(22) PCT Filed: Sep. 30, 2017

(86) PCT No.: PCT/CN2017/104802

§ 371 (c)(1),
(2) Date: Mar. 30, 2020

(87) PCT Pub. No.: WO2019/061409

PCT Pub. Date: Apr. 4, 2019

(65) Prior Publication Data

US 2020/0238697 A1 Jul. 30, 2020

(51) Int. Cl.
*B41J 2/14* (2006.01)

(52) U.S. Cl.
CPC ..... *B41J 2/1433* (2013.01)

(58) Field of Classification Search
CPC ... B41J 2/1433; B41J 2002/14362; B41J 2/14
See application file for complete search history.

(56) References Cited

U.S. PATENT DOCUMENTS

2006/0268063 A1 11/2006 Inaoka et al.

FOREIGN PATENT DOCUMENTS

| | | | | |
|---|---|---|---|---|
| CN | 101054021 | A | | 10/2007 |
| CN | 201471850 | U | * | 5/2010 |
| CN | 102490471 | A | | 6/2012 |
| CN | 202862814 | U | | 4/2013 |
| CN | 205167887 | U | | 4/2016 |
| JP | 57185168 | A | | 11/1982 |

OTHER PUBLICATIONS

IP.com search (Year: 2020).*

(Continued)

*Primary Examiner* — Lisa Solomon

(57) ABSTRACT

A nozzle mount arrangement includes a substrate and a plurality of nozzle assemblies evenly distributed in a length direction of the substrate. The nozzle assembly includes a spray tongue connected to the substrate, a plurality of nozzles evenly distributed in a length direction of the spray tongue, and a locking mechanism provided on the spray tongue for pressing the spray tongue and the nozzle. An inkjet printer includes said nozzle mount arrangement. The nozzle mount arrangement and the inkjet printer have multiple nozzles on the spray tongue, thus the number of spray tongues is reduced, thereby reducing the assembly and maintenance costs of the spray tongues.

14 Claims, 8 Drawing Sheets

(56) References Cited

OTHER PUBLICATIONS

English Machine Translation to Abstract CN101054021.
English Machine Translation to Abstract CN102490471.
English Machine Translation to Abstract CN202862814.
English Machine Translation to Abstract CN205167887.
English Machine Translation to Abstract JP57185168.
English Translation to International Search Report for International Application No. PCT/CN2017/104802.
International Search Report for International Application No. PCT/CN2017/104802.
Written Opinion for International Application No. PCT/CN2017/104802.

* cited by examiner

NOZZLE MOUNT ARRANGEMENT AND INKJET PRINTER

CROSS REFERENCE TO RELATED APPLICATIONS

This application is a 35 U.S.C. § 371 national stage application of PCT Application Ser. No. PCT/CN2017/104802 filed on Sep. 30, 2017, the entire contents of which are incorporated herein by reference.

TECHNICAL FIELD

The present application relates to the technical field of inkjet devices, and more particularly to a nozzle mount arrangement and an inkjet printer with the nozzle mount arrangement.

BACKGROUND

As a large-scale printer product, the inkjet printer plays a very important role in the digital inkjet industry such as advertising production, textile printing, ceramic printing and so on. The nozzle is the core component in the inkjet printer, where the nozzle is fixed on the substrate through the spray tongue with one nozzle being correspondingly provided with one spray tongue, so that the number of tongues is large. In order to achieve a better painting effect, the position of each tongue may need to be adjusted, during the using of assembling spray tongues or later maintenance, which results in higher costs of assembly and maintenance of the spray tongues.

Technical Problem

An object of the present application is to provide a nozzle mount arrangement to solve the technical problem of high cost of assembly and maintenance of the spray tongues caused by the large number of the spray tongues in the inkjet printer existed in prior arts.

Technical Solution

To achieve the above object, the technical solution of the present application is to provide a nozzle mount arrangement which includes a substrate and a plurality of nozzle assemblies evenly distributed in a length direction of the substrate. The nozzle assembly includes a spray tongue connected to the substrate and a plurality of nozzles evenly distributed in a length direction of the spray tongue, and a locking mechanism provided on the spray tongue for pressing the nozzle and the spray tongue against each other.

Further, the spray tongue is provided with a plurality of dovetail slots, and the nozzle is provided with a dovetail block matched with the dovetail slot, and the dovetail block is accommodated in the dovetail slot.

Further, the locking mechanism includes a first pressing block accommodated in the spray tongue with one side abutting against the dovetail block, an adjusting member connected to the first pressing block, and an elastic member fitted through the adjusting member for pressing the first pressing block and the dovetail block against each other.

Further, the locking mechanism further includes a baffle plate provided between the spray tongue and the elastic member, the baffle plate may be solid connected with the spray tongue, and two ends of the elastic member abut against the adjusting member and the baffle plate, respectively.

Further, the locking mechanism further includes a pressure limiting sleeve fitted on the adjusting member, and two ends of the pressure limiting sleeve can abut the adjusting member and the first pressing block.

Further, the first pressing block includes a side pressing portion abutting against the dovetail block.

Further, the first pressing block further includes a base portion connected to the side pressing portion, a bottom groove for receiving the base portion is provided at the bottom of the dovetail slot, and a side for the dovetail slot is provided with a side groove for accommodating the side pressing portion, and wherein the side groove and the bottom groove communicate with each other.

Further, the adjusting member includes an adjusting head and an adjusting rod connected to each other, the adjusting rod is connected to the base portion, and one end of the elastic member abuts against the adjusting head.

Further, the locking mechanism further includes a second pressing block accommodated in the spray tongue, and a fastener passing through the baffle plate and forming a solid connection with the second pressing block, and one side of the second pressing block abuts against the dovetail block.

Further, the locking mechanism includes two first pressing blocks respectively disposed at two ends of the dovetail slot, and the second pressing block is disposed between the two first pressing blocks.

Further, the substrate is provided with a plurality of escape grooves for providing void space for the elastic member and the adjusting member.

Further, a plurality of removal holes for disassembling the nozzle are provided at the bottom of the escape groove.

Further, the substrate is provided with a positioning plate for positioning a plurality of the spray tongues.

The present application also provides an inkjet printer including the above-mentioned nozzle mount arrangement.

Beneficial Effect

Compared to the prior arts, the nozzle mount arrangement provided by the present application has beneficial effects in that: the nozzle mount arrangement of the present application reduces the number of spray tongues provided on the substrate as one single spray tongue is provided with multiple nozzles, thereby reducing the workload of adjusting the position of the spray tongues, so that the assembly and maintenance costs of the spray tongues are reduced.

Compared to the prior arts, the inkjet printer provided by the present application has beneficial effects in that: with the above-mentioned nozzle mount arrangement, the number of the spray tongues is reduced, thereby reducing the workload of adjusting the position of the spray tongues, so that costs of the assembly and maintenance of the spray tongues are reduced.

BRIEF DESCRIPTION OF THE DRAWINGS

In order to explain the technical solutions of embodiments of the present application more clearly, the drawings used in the description of the embodiments will be briefly described hereinbelow. Obviously, the drawings in the following description are some embodiments of the present application, and for persons skilled in the art, other drawings may also be obtained on the basis of these drawings without creative efforts.

LIST OF THE REFERENCE CHARACTERS

Figure 1:
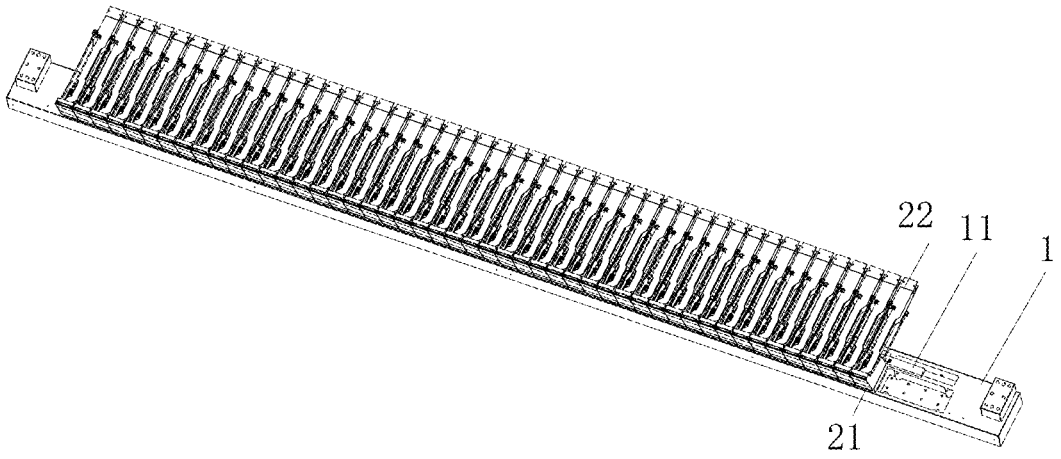
FIG. 1 is a perspective structural view of a nozzle mount arrangement in accordance with an embodiment of the present application.

In the figures: 1—substrate; 11—positioning plate; 12—escape groove; 13—removal hole; 14—second connection hole; 2—nozzle assembly; 21—spray tongue; 211—first receiving groove; 2111—side groove; 2112—bottom groove; 212—second receiving groove; 213—dovetail slot; 214—first connection hole; 2140—sink groove; 22—nozzle; 221—dovetail block; 23—locking mechanism; 231—adjusting member; 232—elastic member; 233—first pressing block; 2330—fourth connection hole; 2331—side pressing portion; 2332—base portion; 234—baffle plate; 2341—third connection hole; 2342—fifth connection hole; 235—pressure limiting sleeve; 236—second pressing block; 237—fastener.

DETAILED DESCRIPTION OF THE EMBODIMENTS

In order to explain the technical problems to be solved by the present application as well as technical solutions and beneficial effects corresponding to the present application more clearly, the present application will be further described in detail with reference to the accompanying drawings and embodiments. It should be understood that the specific embodiments described herein are merely used to explain the application, and are not intend to limit the application.

It should be noted that when an element is referred to as being "fixed to" or "disposed on" another element, it may be directly or indirectly on the other element. When an element is referred to as being "connected to" another element, it may be directly or indirectly connected to the other element.

It should be understood that the orientations or positional relationships indicated by terms "length", "width", "upper", "down", "front", "back", "left", "right", "vertical", "horizontal", "top", "bottom", "inside", "outer", etc. are based on the orientations or positional relationships shown in the drawings, which are merely used for the convenience of describing this application and simplifying the description without indicating or implying the referred devices or elements must have a specific orientation or be constructed and operate in a specific orientation, and therefore cannot be understood as limitations to this application.

Furthermore, the terms "first", "second", and the like are used for descriptive purposes only, and should not be understood as indicating or suggesting relative importance or implicitly indicating the number of technical features referred thereto. Therefore, features defined as "first" and "second" may explicitly or implicitly include one or more of this features. In the description of the present application, "a plurality" means two or more, unless specifically defined otherwise.

Please refer to FIG. 1 to FIG. 3, the nozzle mount arrangement provided in the present application will now be described. The nozzle mount arrangement includes a substrate 1 and a plurality of nozzle assemblies 2, and the plurality of nozzle assemblies 2 are evenly distributed on the substrate 1 in a length direction of the substrate 1. The number of the nozzle assemblies 2 can be selected according to the width of the desired printing product, which is not limited here. The nozzle assembly 2 includes spray tongue 21, a plurality of nozzles 22 and a locking mechanism 23 for locking the spray tongue 21 and the nozzle 22. The spray tongue 21 may be connected to the substrate 1, and a plurality of nozzles 22 are evenly distributed in a length direction of the spray tongue 21. The nozzles 22 and the locking mechanism 23 are both disposed on the spray tongue 21. One single spray tongue 21 may be provided with a plurality of nozzles 22, the number of the nozzles 22 may be two, three, four, etc. The number of the nozzles 22 on each spray tongue 21 is the same, but the specific number is not limited. The number of the spray tongues 21 in the nozzle mount arrangement is small, thus reduces the workload of assembling or adjusting the position of the spray tongues 21.

Compared to the prior arts, the nozzle mount arrangement provided by the present application has a plurality of spray tongues 21 provided on the substrate 1 and a plurality of nozzles 22 provided on a single spray tongue 21, so that the number of the spray tongues 21 is reduced, thereby reducing the workload of adjusting the position of the spray tongues 21 and thus reduces the costs of the assembly and maintenance of the spray tongues.

Figure 2:
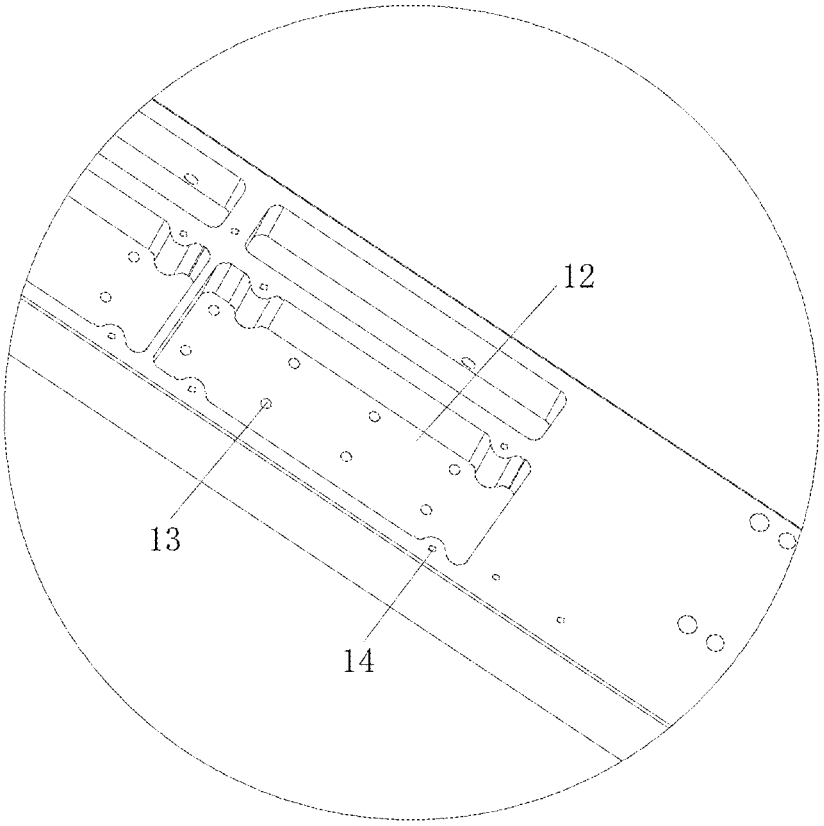
FIG. 2 is a perspective structural view of a substrate in accordance with an embodiment of the present application.
Figure 5:
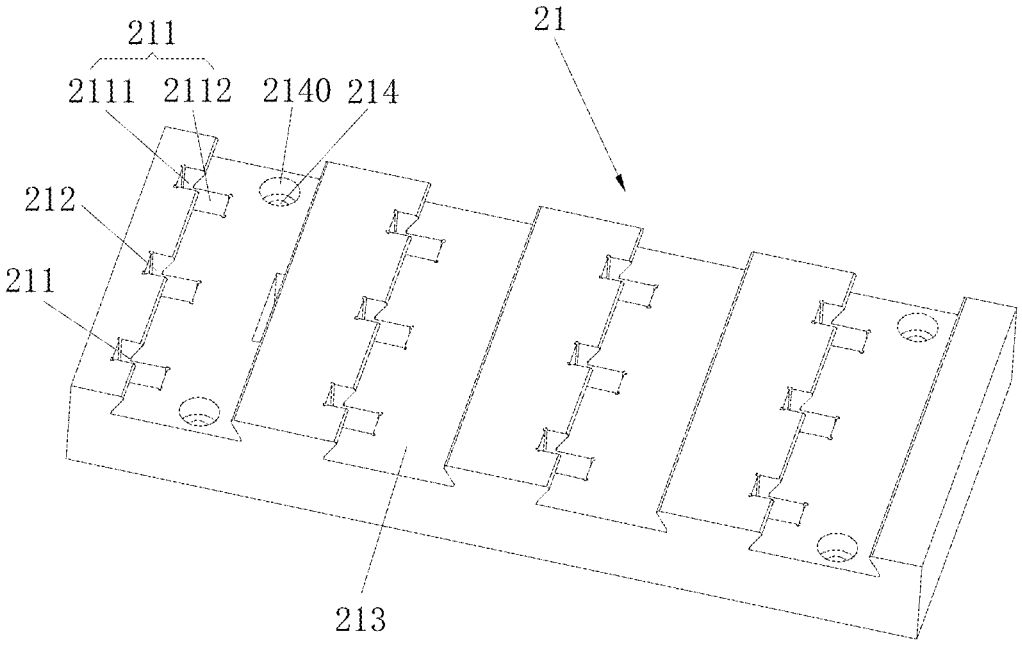
FIG. 5 is a perspective structural view of a spray tongue in accordance with an embodiment of the present application.
Figure 6:
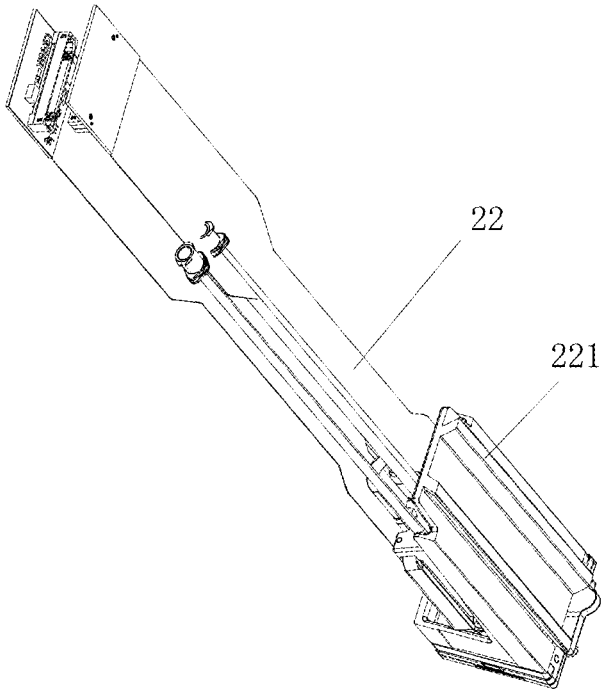
FIG. 6 is a perspective structural view of a nozzle in accordance with an embodiment of the present application.

Further, referring to FIG. 2 and FIG. 5, as a specific implementation of the nozzle mount arrangement provided in the present application, the spray tongue 21 may be detachably connected with the substrate 1, and preferably, the spray tongue 21 is threadedly connected with the substrate 1. The spray tongue 21 may be provided with a plurality of first connection holes 214, and the substrate 1 may be provided with a plurality of second connection holes 14 facing the first connection hole 214. The first connection hole 214 is a through hole, and sink grooves 2140 may be provided at the edge of the first connection holes 214, and the second connecting hole is a threaded hole. A screw or bolt pass through the first connection hole 214 to form a threaded connection with the second connection hole 14, and the head of the screw or bolt is received in the sink groove 2140 to avoid interference with the nozzle 22. As the spray tongue 21 is detachably connected with the nozzle 22, it facilitates the adjustment of the relative position between the spray tongues 21, facilitates the later disassembly and installation of the spray tongue 21, and facilitates the maintenance and replacement of the spray tongue 21 and the nozzle 22, and moreover, the spray tongues 21 and the number of nozzles can be reasonably selected according to the width of the desired printed product, thereby reducing the consumption cost of the user.

Figure 3:
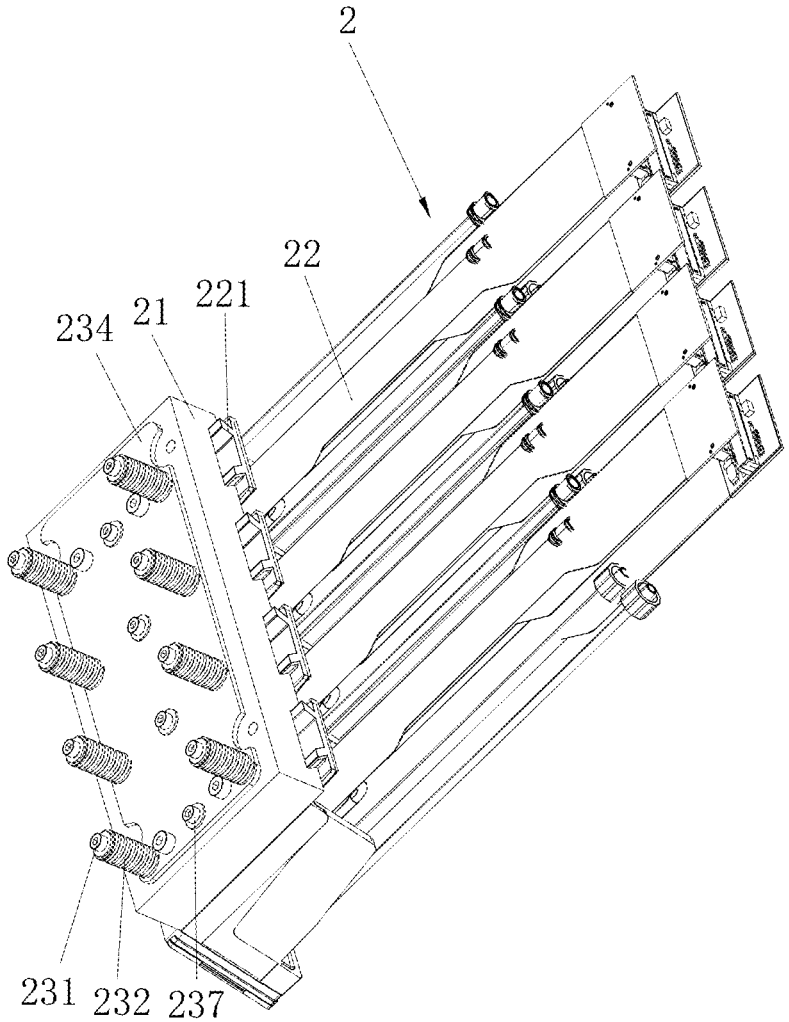
FIG. 3 is a perspective structural view of a nozzle assembly in accordance with an embodiment of the present application.
Figure 4:
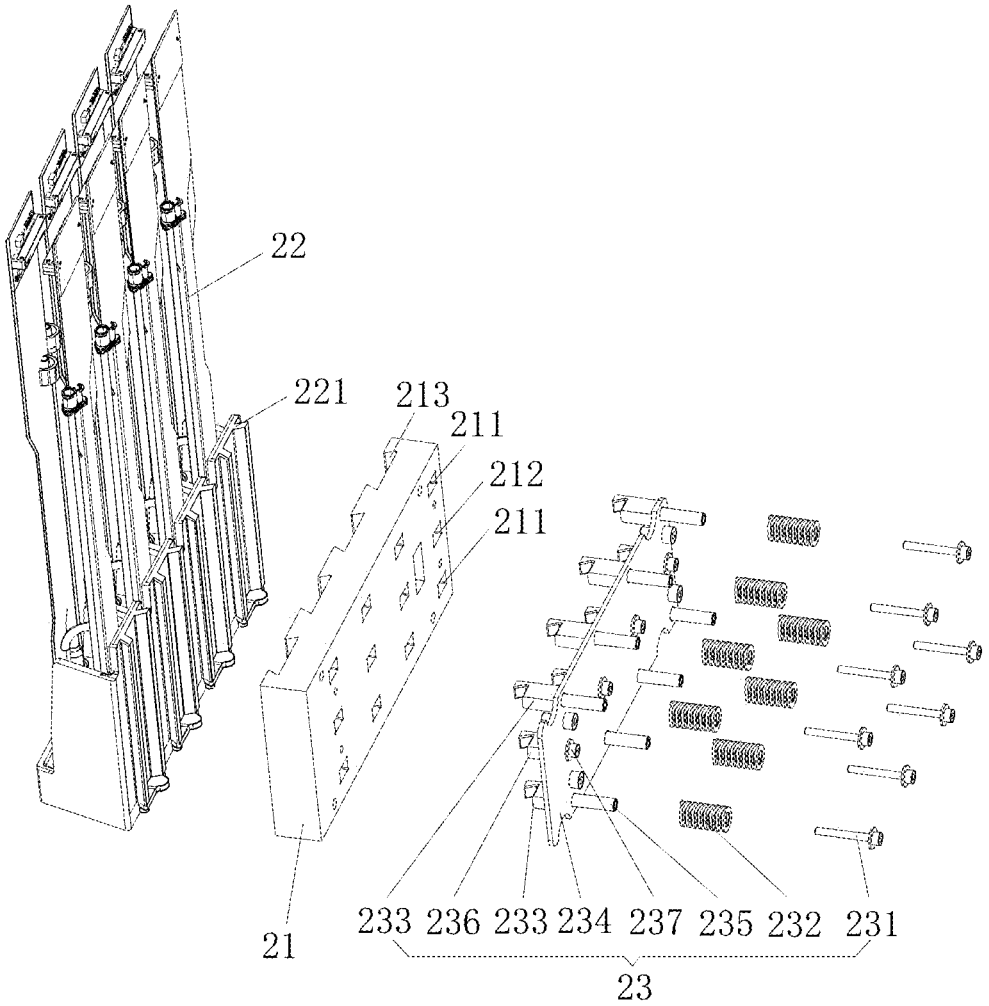
FIG. 4 is an exploded view of the nozzle assembly in accordance with an embodiment of the present application.

Further, referring to FIG. 3 to FIG. 5, as a specific implementation of the nozzle mount arrangement provided in the present application, the spray tongue 21 is provided with a plurality of dovetail slots 213, and the number of the dovetail slots 213 is the same as the number of the nozzle 22, The nozzle 22 is provided with a dovetail block 221 matched with the dovetail slot 213, and the dovetail block 221 is accommodated in the dovetail slot 213, so that the spray tongue 21 is connected with the nozzles 22. The dovetail slots 213 and the matching dimensions of the spray tongue 21 and the substrate 1 are all formed by slow wire sparks in one process which is not only simplify the process, but also provides a dimensional accuracy as 0.01 mm, so that a magnifying glass may not be required to determine its location when assembling the spray tongue 21, thereby simplifying its mount process.

Further, referring to FIG. 3 and FIG. 4, as a specific implementation of the nozzle mount arrangement provided in the present application, the locking mechanism 23 includes first pressing blocks 233, adjusting members 231 and elastic members 232. The first pressing blocks 233 may be accommodated in the spray tongue 21 and abut against the dovetail block 221 for locking with the dovetail blocks 221; the adjusting members 231 may be in connection with the first pressing blocks 233, and the adjusting members 231 can control the compression of the elastic elements 232, and further control pressures between the first pressing blocks 233 and the dovetail blocks 221. The elastic members 232 may be fitted on the adjusting members 231, and the restoring force can press the first pressing blocks 233 and the dovetail blocks 221 against each other. The pressures between the first pressing blocks 233 and the dovetail blocks 221 increase when the adjusting members 231 compress the elastic members 232. The pressures between the first pressing blocks 233 and the dovetail blocks 221 decrease when the adjusting members 231 make the elastic members 232 rebound. The locking mechanism 23 may include a plurality of first pressing blocks 233, preferably two first pressing blocks 233 being respectively disposed at two ends of the dovetail slot 213. Preferably, the elastic member 232 is a spring.

Figure 8:
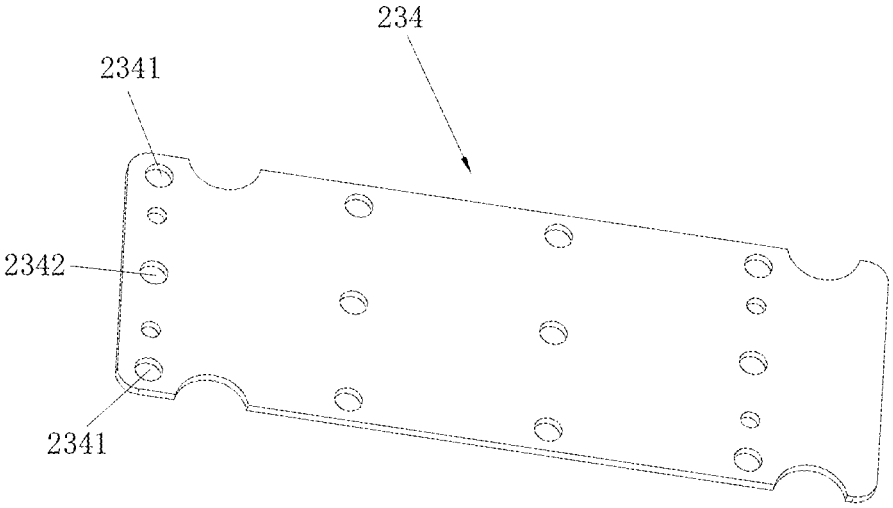
FIG. 8 is a perspective structural view of a baffle plate in accordance with an embodiment of the present application.

Further, please refer to FIG. 4, FIG. 5 and FIG. 8. As a specific implementation of the nozzle mount arrangement provided in the present application, the locking mechanism 23 further includes a baffle plate 234 provided between the spray tongue 21 and the elastic members 232. The baffle plate 234 is fixed on the spray tongue 21, and two ends of the elastic member 232 abut against the adjusting member 231 and the baffle plate 234, respectively. The baffle plate 234 is provided with third connection holes 2341 for the adjusting members 231 to pass through. The adjusting members 231 may be connected to the first pressing blocks 233 through the third connection holes 2341. The spray tongue 21 may be provided with first receiving grooves 211 for receiving the first pressing blocks 233. Preferably, the first receiving groove 211 is a through groove. The through groove is convenient for processing. The baffle plate 234 can prevent the first pressing blocks 233 from falling out of the first receiving grooves 211. Of course, the first receiving groove 211 may be a blind groove, and the third connection holes 2341 may be provided at the bottom of the blind grooves, and the first pressing blocks 233 can be prevented from falling out of the first receiving groove 211.

Further, referring to FIG. 4 and FIG. 8, as a specific implementation of the nozzle mount arrangement provided in the present application, the locking mechanism 23 further includes pressure limiting sleeves 235 fitted on the adjusting members 231, and two ends of the pressure limiting sleeve 235 can abut against the adjusting member 231 and the first pressing block 233, respectively. Specifically, the pressure limiting sleeves 235 may be disposed between the adjusting members 231 and the elastic members 232, respectively. One end of the pressure limiting sleeve 235 passes through the third connection hole 2341 and operably abut against the first pressing block 233. The locking mechanism 23 may include a plurality of first pressing blocks 233, and a plurality of locking mechanisms 23 may be provided on the spray tongue 21. The number of the locking mechanisms 23 is the same as the number of the nozzles 22. In order to ensure the locking force of each locking mechanism 23 is the same, pressure-limiting sleeves 235 of the same length may be respectively provided in each locking mechanism 23, so that the locking force of each locking mechanism 23 is the same. When the locking force of the spray tongue 21 and the nozzle 22 reach the maximum, both ends of the pressure limiting sleeve 235 abut against the first pressing block 233 and the adjusting member 231, respectively, so the pressure between the first pressing block 233 and the dovetail block 221 is determined by the length of the pressure limiting sleeve 235, when the pressure limiting sleeve 235 in each locking mechanism 23 has a same length, the locking force thereof may be the same.

Figure 7:
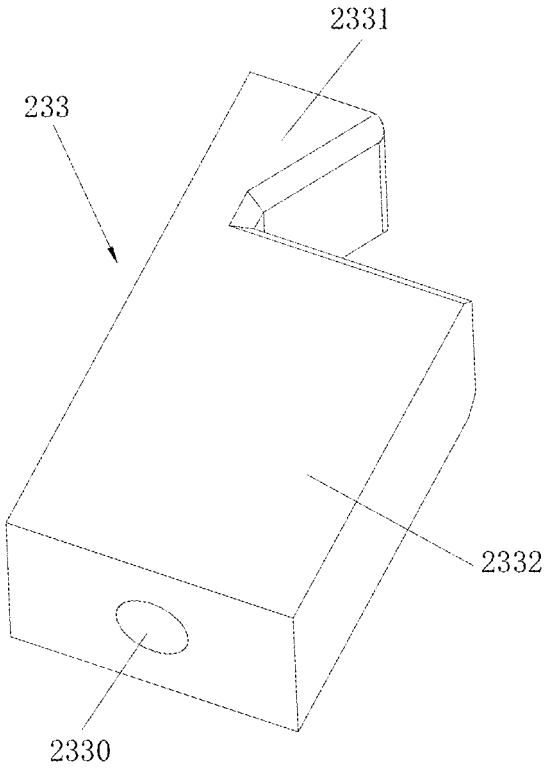
FIG. 7 is a perspective structural view of a first pressing block used in an embodiment of the present application.

Further, please refer to FIG. 4 and FIG. 7, as a specific implementation of the nozzle mount arrangement provided in the present application, the first pressing block 233 includes a side pressing portion 2331 and a base portion 2332 connected to each other, where one side of the side pressing portion 2331 abuts against the dovetail block 221. Specifically, the side pressing portion 2331 is provided as a right-angled triangular block, the inclined surface of which abuts against the dovetail block 221, the base portion 2332 is provided with a fourth connection hole 2330, and the adjusting member 231 is connected to the base portion 2332 through the fourth connection hole 2330. Both the side pressing portion 2331 and the base portion 2332 are received in the first receiving groove 211 of the spray tongue 21.

Further, referring to FIG. 5 and FIG. 7, as a specific implementation of the nozzle mount arrangement provided in the present application, the first receiving groove 211 includes a side groove 2111 for receiving the side pressure portion 2331 and a bottom groove 2112 for receiving the base portion 2331, where the side groove 2111 and the bottom groove 2112 communicate with each other. The side groove 2111 is opened at the dovetail side of the dovetail slot 213, and the bottom groove 2112 is opened at the bottom of the dovetail slot 213. As described above, the bottom groove 2112 may be a through groove or a blind groove, and the third connection hole 2341 is provided at the bottom of the blind groove.

Further, referring to FIG. 4, as a specific implementation of the nozzle mount arrangement provided in the present application, the adjusting member 231 includes an adjusting head (not labeled in the figure) and an adjusting rod (not labeled in the figure), and the adjusting rod is connected to the base portion 2332 through the fourth connection hole 2330. Preferably, the adjusting rod forms a threaded connection with the base portion 2332. At the same time, one end of the elastic member 232 abuts against the adjusting head, and the other end abuts against the baffle plate 234. When the locking force of the spray tongue 21 and the nozzle 22 is maximum, the two ends of the pressure limiting sleeve 235 abut against the adjusting head and the base portion 2332, respectively.

Further, referring to FIG. 4 and FIG. 8, as a specific implementation of the nozzle mount arrangement provided in the present application, the locking mechanism 23 further includes second pressing blocks 236 and fasteners 237 being solid connected with the second pressing blocks 236. The second pressing blocks 236 may also be accommodated in the spray tongue 21. Specifically, the spray tongue 21 is further provided with second receiving grooves 212 for receiving the second pressing blocks 236. The baffle plate 234 may also provided with fifth connection holes 2342 through which the fasteners 237 pass. The fasteners 237 pass through the fifth connection holes 2342 to form a solid connection with the second pressing blocks 236, respectively. The second pressing block 236 may be disposed between the two first pressing blocks 233. Similarly, the second receiving groove 212 may be a through groove or a blind groove, and the fifth connection holes 2342 may be provided at the bottom of the blind slots. The second pressing blocks 236 may also used to lock the dovetail blocks 221 on the nozzles 22. When the nozzle mount arrangement is shaken or swayed, the adjusting members 231 may loosen, which may cause the first pressing blocks 233 and the dovetail blocks 221 to loosen. To prevent this, the second pressing block 236 may be provided to lock the dovetail block 221 thereby ensuring a stable connection between the nozzle 22 and the spray tongue 21.

Further, referring to FIG. 5 and FIG. 7, as a specific implementation of the nozzle mount arrangement provided in the present application, the first pressing block 233 and the second pressing block 236 may be disposed on the same side of the dovetail slot 213, and two first pressing blocks 233 may be provided for pressing one nozzle 22. For example, the spray tongue 21 is provided with four dovetail slots 213, then four nozzles 22 can be mounted. a side of one single dovetail slot 213 are provided with two first pressing blocks 233, in which the second pressing block 236 and the first pressing block 233 are located on the same side of the dovetail slot 213. Specifically, the first pressing block 233 and the second pressing block 236 have the same structure, and similarly, the first receiving groove 211 and the second receiving groove 212 have the same structure.

Further, referring to FIG. 2, as a specific implementation of the nozzle mount arrangement provided in the present application, the substrate 1 is provided with a plurality of escape grooves 12, and the number of the escape grooves 12 is greater than or equal to the number of the spray tongues 21. The escape grooves 12 are provided to reduce the overall weight of the inkjet printer, and to provide void space for the elastic members 232, the adjusting members 231 and the fasteners 237, etc., so as to facilitate the connection between the nozzles 22 and the spray tongue 21.

Further, please continue to refer to FIG. 2, as a specific implementation of the nozzle mount arrangement provided in the present application, a plurality of removal holes 13 are provided at the bottom of the escape groove 12. Specifically, each of the adjusting member 231 and the fastener 237 is provided with a removal hole 13 below. During the use of the inkjet printer, it is often necessary to adjust or replace the nozzle 22 or the spray tongue 21, and the setting of removal hole 13 facilitates the removal of the adjusting member 231 and the fastener 237 with a disassembly tool through the removal hole 13. Further, the nozzle 22 is detached from the spray tongue 21, and then the spray tongue 21 is detached from the substrate 1.

Further, referring to FIG. 1, as a specific implementation of the nozzle mount arrangement provided in the present application, a positioning plate 11 is provided on the substrate 1. Specifically, the positioning plate 11 is disposed on one side of the spray tongue 21 and is mounted on the substrate 1 for positioning a plurality of spray tongues 21. The positioning plate 11 has high accuracy during an installation of the spray tongues 21, one side of each spray tongue 21 can directly abuts against one side of the positioning plate 11 thereby avoiding the use of a magnifying glass and judging the relative position of each spray tongue 21 with the naked eye, thus reduces the difficulty of mounting the spray tongue 21. There may be multiple positioning plates 11, and the number of the positioning plates 11 may be determined according to the length of the substrate 1.

The present application also provides an inkjet printer which includes the above-mentioned nozzle mount arrangement.

The he present application provides the inkjet printer with the above-mentioned nozzle mount arrangement, in which the number of spray tongues 21 is reduced, thereby reducing the workload of adjusting the position of the spray tongue 21, and thus reduces the assembly and maintenance costs of the spray tongue 21.

The foregoing description are merely preferred embodiments of the present application, and are not intended to limit the present application; any modifications, equivalent substitutions and improvements made within the spirit and principles of the disclosure should be understood as being included within the scope of the present application.

The invention claimed is:

1. A nozzle mount arrangement, comprising: a substrate and a plurality of nozzle assemblies evenly distributed in a length direction of the substrate, each of the nozzle assemblies including:

a spray tongue connected to the substrate and a plurality of nozzles evenly distributed in a length direction of the spray tongue; and a locking-mechanism provided on the spray tongue for pressing the spray tongue and the nozzle against each other.

2. The nozzle mount arrangement according to claim 1, wherein the spray tongue is provided with a plurality of dovetail slots, and the nozzle is provided with a dovetail block matching the dovetail slot, and the dovetail block is accommodated in the dovetail slot.

3. The nozzle mount arrangement according to claim 2, wherein the locking mechanism comprises a first pressing block accommodated in the spray tongue with one side abutting against the dovetail block, an adjusting member connected to the first pressing block, and an elastic member fitted on the adjusting member for pressing the first pressing block and the dovetail block against each other.

4. The nozzle mount arrangement according to claim 3, wherein the locking mechanism further comprises a baffle plate provided between the spray tongue and the elastic member, the baffle plate is solid connected with the spray tongue, and two ends of the elastic member abut against the adjusting member and the baffle plate, respectively.

5. The nozzle mount arrangement according to claim 4, wherein the locking mechanism further comprises a pressure limiting sleeve fitted on the adjusting member, and two ends of the pressure limiting sleeve abut against the adjusting member and the first pressing block.

6. The nozzle mount arrangement according to claim 3, wherein the first pressing block comprises a side pressing portion abutting against the dovetail block.

7. The nozzle mount arrangement according to claim 6, wherein the first pressing block further comprises a base portion connected to the side pressing portion, a bottom groove for accommodating the base portion is provided at the bottom of the dovetail slot, and a side of the dovetail slot is provided with a side groove for accommodating the side pressing portion, and wherein the side groove and the bottom groove communicate with each other.

8. The nozzle mount arrangement according to claim 6, wherein the adjusting member comprises an adjusting head and an adjusting rod connected to each other, the adjusting rod is connected with the base portion, and one end of the elastic member abuts against the adjusting head.

9. The nozzle mount arrangement according to claim 4, wherein the locking mechanism further comprises a second pressing block accommodated in the spray tongue, and a fastener configured to pass through the baffle plate to form a solid connection with the second pressing block, and wherein one side of the second pressing block abuts against the dovetail block.

10. The nozzle mount arrangement according to claim 9, wherein the locking mechanism comprises two first pressing blocks respectively disposed at two ends of the dovetail slot, and the second pressing block is disposed between the two first pressing blocks.

11. The nozzle mount arrangement according to claim 3, wherein the substrate is provided with a plurality of escape grooves for providing void space for the elastic member and the adjusting member.

12. The nozzle mount arrangement according to claim 11, wherein a plurality of removal holes for disassembling the nozzle are provided at the bottom of the escape groove.

13. The nozzle mount arrangement according to claim 1, wherein the substrate is provided with a positioning plate for positioning a plurality of the spray tongues.

14. An inkjet printer with a nozzle mount arrangement, wherein the nozzle mount arrangement comprising:

a substrate and a plurality of nozzle assemblies evenly distributed in a length direction of the substrate, each of the nozzle assemblies including:

a spray tongue connected to the substrate and a plurality of nozzles evenly distributed in a length direction of the spray tongue; and a locking mechanism provided on the spray tongue for pressing the spray tongue and the nozzle against each other.

* * * * *